United States Patent [19]

Sueishi et al.

[11] 3,963,002

[45] June 15, 1976

[54] ELECTRONICALLY CONTROLLED FUEL INJECTION SYSTEM

[75] Inventors: Motoharu Sueishi, Kariya; Susumu Harada, Obu, both of Japan

[73] Assignee: Nippondenso Co., Ltd., Aichi, Japan

[22] Filed: Sept. 9, 1974

[21] Appl. No.: 504,248

[30] Foreign Application Priority Data

Sept. 14, 1973 Japan ..... 48-104429

[52] U.S. Cl. ..... 123/32 EA; 60/276

[51] Int. Cl.[2] ..... F02B 3/00

[58] Field of Search ..... 123/32 EA, 140 MC; 60/276

[56] References Cited

UNITED STATES PATENTS

| | | | |
|---|---|---|---|
| 3,576,182 | 4/1971 | Howland | 123/140 MC |
| 3,738,341 | 6/1923 | Loos | 123/32 EA |
| 3,745,768 | 7/1973 | Zechnall | 60/276 |

*Primary Examiner*—Charles J. Myhre
*Assistant Examiner*—Ronald B. Cox
*Attorney, Agent, or Firm*—Cushman, Darby & Cushman

[57] ABSTRACT

An electronically controlled fuel injection system mounting an oxygen content detector in the exhaust system of the engine comprises at least two kinds of fuel injection valve, one of which has a different injection opening from the other, whereby an optimum air-fuel ratio for reducing harmful components in the exhaust gas from the engine is obtained.

2 Claims, 7 Drawing Figures

ELECTRONICALLY CONTROLLED FUEL INJECTION SYSTEM

BACKGROUND OF THE INVENTION

This invention relates to an improved and electronically controlled fuel injection system having an oxygen content detector mounted in the exhaust system thereof to control the fuel injection in accordance with the oxygen content in the exhaust system, thereby reducing the harmful components in the exhaust gas.

Generally the amount of oxygen in the exhaust gas varies with air-fuel ratio as shown in FIG. 1. Conventional oxygen content detectors generate in response thereto an electromotive force as shown in FIG. 2 having a peculiar point at the air-fuel ratio of about 14.8 which corresponds to the starting point of oxygen ($O_2$) content in the curve of FIG. 1. Conventional oxygen content detectors are formed of a metal oxide, such as Zirconium dioxide and Titanium dioxide, and generate an electromotive force when heated. A difference of oxygen content is produced between one side of the detector and the other by the movement of oxygen ions.

In a conventional fuel injection system mounting such oxygen content detector, the air-fuel ratio is controlled at no other value than the theoretical one of 14.8, since the electromotive force of the detector changes abruptly at the point of about 14.8 as seen from FIG. 2, making detection of the point easy. The detector supplies the control signal generated therein to a computer, which operates to modify the injection pulse so that the air-fuel ratio always keeps a value of about 14.8 by increasing the fuel when the ratio is above 14.8 and decreasing it when below 14.8.

SUMMARY OF THE INVENTION

According to one embodiment of this invention, the air-fuel ratio, can be varied from the theoretical value of 14.8. This is accomplished by utilizing two groups of fuel injection valves having different sized injection openings. A conventional oxygen detector which produces a easy to detect signal is mounted in one exhaust line which connects to one group of valves so that the overall air-fuel ratio can be varied from the theoretical 14.8 value.

DETAILED DESCRIPTION OF THE PREFERRED EMBODIMENT

Figure 3:
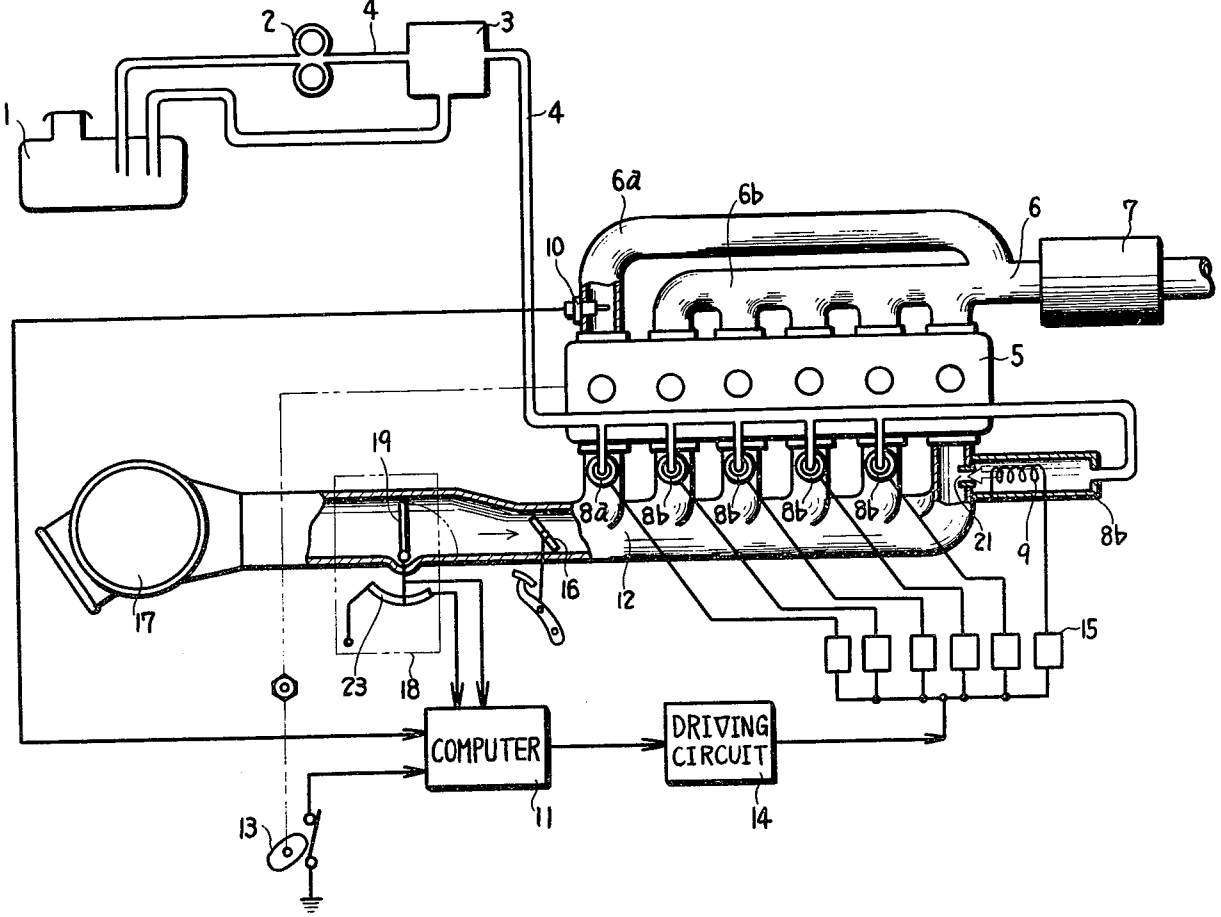
FIG. 3 shows a schematic plan view of the electronically controlled fuel injection system of the present invention.
Figure 4A:
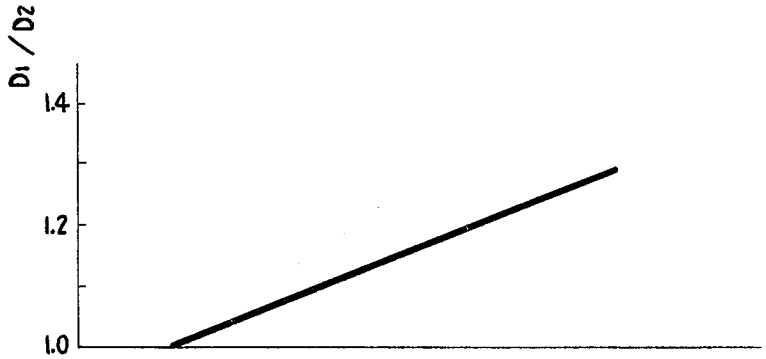
FIGS. 4*a* and 4*b* show graphs representing the relation between air-fuel ratio and diameter ratio of the injection openings of the fuel injection valves of the present invention.
Figure 4B:
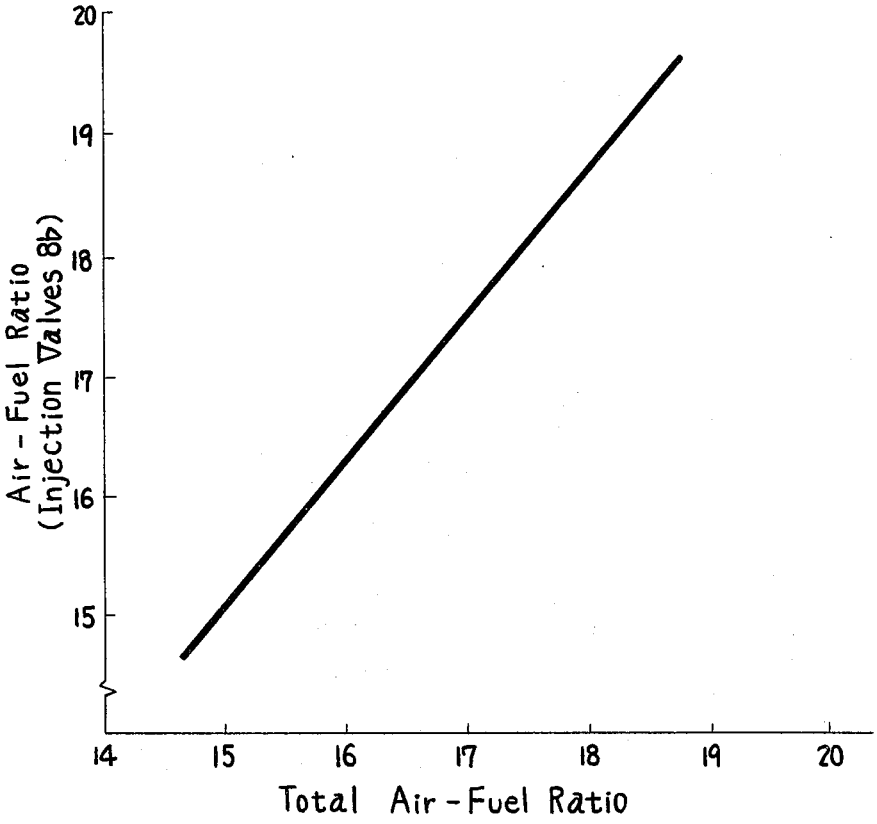

Referring to FIG. 3, numeral 1 designates a fuel tank, 2 a fuel pump, 3 a pressure regulator which is connected with the tank and pump by fuel pipes 4, regulating the pressure of fuel constant. Numeral 5 designates a 6-cylinder internal combustion engine, whose exhaust pipes 6 are divided into two groups 6*a* and 6*b* near the exhaust port of the engine 5 and open to the atmosphere through a silencer 7. Numerals 8*a* and 8*b* designate fuel injection valves divided into two groups corresponding to the exhaust pipes 6*a* and 6*b*. In this embodiment, one group of the injection valves consists of one valve 8*a* and the other group of the injection valves consists of 5 valves 8*b*. Numeral 9 designates electromagnetic coils mounted in the fuel injection valves 8*a* and 8*b* for operating those valves. Numeral 21 designates an injection opening of the fuel injection valve 8*b* through which the fuel is injected into the engine 5 when the valve is energized to open. The injection openings 21 of the fuel injection valves 8*b* have smaller diameter than that of the injection opening of the fuel injection valve 8*a* in this embodiment. As the result, the fuel injection valves 8*b* each inject less fuel than valve 8*a*, since the injection valves 8*a* and 8*b* open for exactly the same time period. For example, when the diameter of the injection opening 21 of the fuel injection valves 8*b* is 0.77 times that of the diameter of valve 8*a* and when the air-fuel ratio of the fuel injected from the fuel injection valve 8*a* is kept at 14.8, the air-fuel ratio of the fuel injected from the valves 8*b* becomes 19.15 and the total average air-fuel ratio becomes 18.5 which is a suitable value for the engine to reduce the harmful components in the exhaust gas. The ratio of the diameters of the injection openings 21 can be set at various values from 0.7 to 1.3 for obtaining various total air-fuel ratios. Further the ratio can be controlled at various values in response to engine parameters such as vacuum pressure in the intake pipe 12. When the diameter of the injection opening of the fuel injection valve 8*a* is D1 and that of the valves 8*b* is D2, the total air-fuel ratio varies as shown in FIG. 4*a* according to the ratio D1/D2. Likewise, the total air-fuel ratio also varies as the air-fuel ratio of the fuel injection valves 8*b* varies as shown in the FIG. 4*b*. Numeral 10 designates above-explained oxygen content detector mounted in the exhaust pipe 6*a*. Numeral 11 designates a conventional computer, 12 an intake pipe, 13 a revolution detector connected to a crank shaft of the engine 5 to close two times per one crank shaft revolution. Numeral 14 designates a driving circuit for energizing the fuel injection valves 8*a* and 8*b* via resistors 15. Numeral 16 designates a throttle valve for controlling the output power of the engine 5, 17 an air cleaner, 18 an air-flow meter mounted at an upstream part of the throttle valve 16 and having a plate 19 which turns according to the air amount passing therethrough to produce an electric signal across a variable resistor 23.

Figure 5:
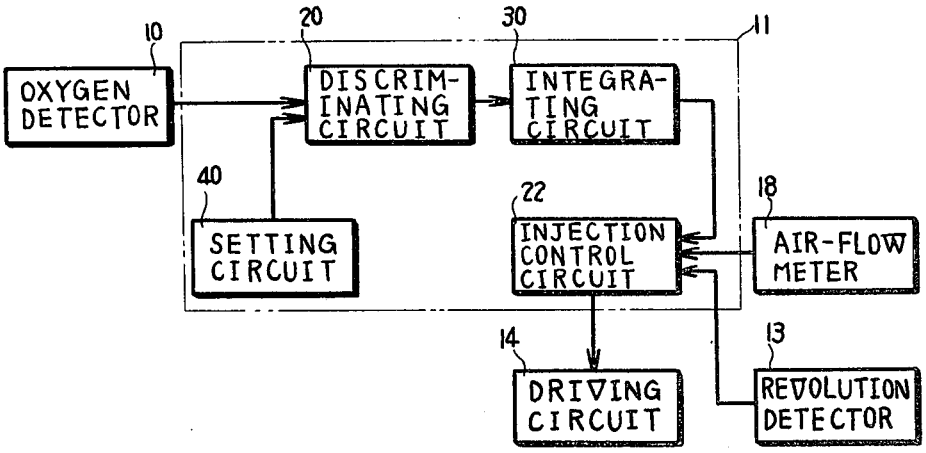
FIG. 5 shows a block diagram of the computer of the present invention.
Figure 6:
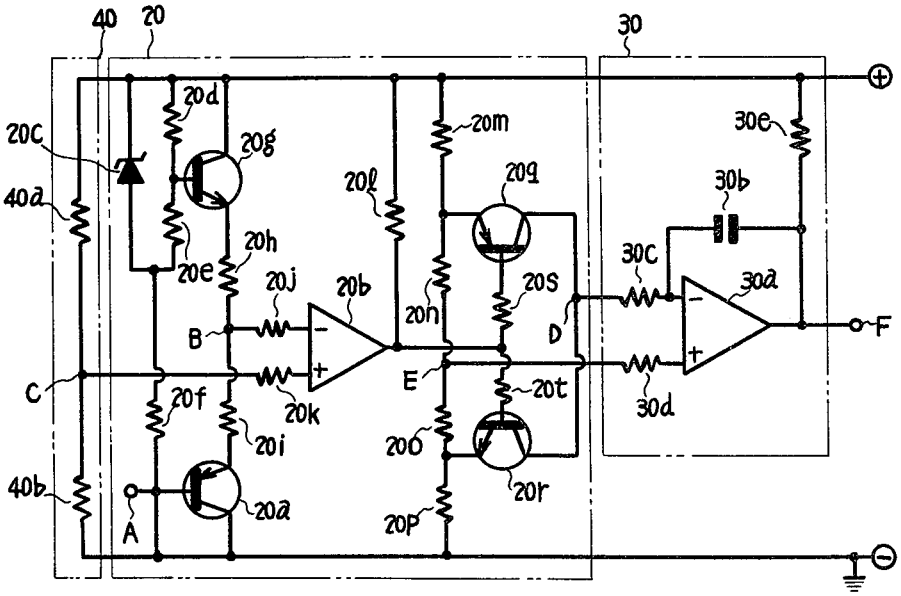
FIG. 6 shows an electric diagram of main part of the computer of the present invention.

One embodiment of the computer 11 will be explained below. Referring to FIG. 5, numeral 20 designates a discriminating circuit connected with the oxygen content detector 10 for comparing actual air-fuel ratio with a set value which is brought thereinto from a setting circuit 40. Numeral 30 designates an integrating circuit connected with the discriminating circuit 20, the output of which varies in response to the output of the discriminating circuit 20. Numeral 22 designates an injection control circuit of usual type which is conventional and described in printed publications such as Japanese provisional publication No. 47-9757. The circuit 22 determines the duration of the injection pulse in accordance with the output signal of the circuit 30 and voltage level signal coming from the air-flow meter 18 in response to the signal applied from the revolution detector 13. The injection pulse produced in the injection control circuit 22 is applied to the fuel injection valves 8*a* and 8*b* of the engine 5 through the driving circuit 14 and resistors 15. Referring to FIG. 6, the main circuit of above-described embodiment will be explained. Numerals 40*a* and 40*b* designate resistors for fixing the set value in response to the temperature of the exhaust gas, 20*a* an input transistor to point A of which the signal from the oxygen content detector 10 is applied. 20*b* a voltage comparator, 20*c* a Zener diode, 20*d*, 20*e* and 20*f* resistors, 20*g* a transistor, 20*h* and 20*i* emitter resistors, 20*j* and 20*k* input resistors for the voltage comparator 20*b*, 20*l* a bias resistor, 20*m*, 20*n*, 20*o* and 20*p* resistors for setting voltage level of point E, 20*q* and 20*r* transistors, 20*s* and 20*t* base resistors. This circuit makes the voltage at point D higher than that at point E when the output of the voltage comparator 20 *b* is in a low level and the voltage relation between point D and E reverses when the output is in a high level.

Figure 1:
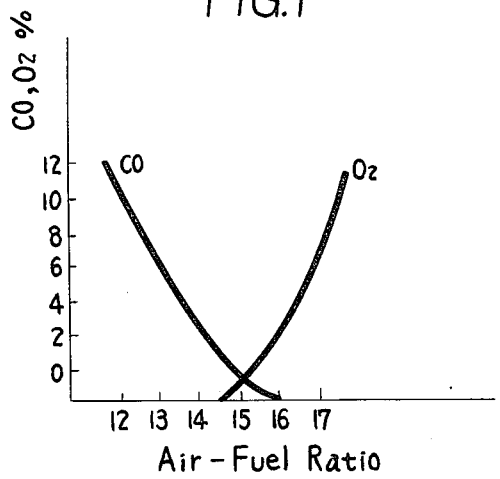
FIG. 1 shows a graph representing the relation between air-fuel ratio and two typical components in the exhaust gas.
Figure 2:
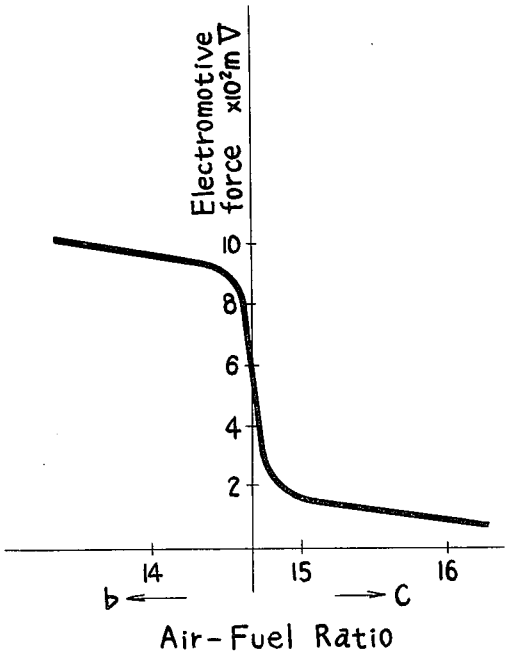
FIG. 2 shows a graph representing the relation between air-fuel ratio and electromotive force generated in the oxygen content detector.

Numeral 30*a* is an operational amplifier, 30*b* a capacitor which forms an integrator with the amplifier 30*a*, 30*c* and 30*d* input resistors, 30*e* a bias resistor. When the signal of the oxygen content detector 10 is in the range *b* in FIG. 2, making the output level higher, the voltage comparator 20*b* compares the voltage at point B which is corresponding to the signal from the detector 10 with the set voltage at point C to produce low level output signal. Then the transistor 20*q* becomes conductive to make the voltage level at point D higher than that of point E. Therefore the operational amplifier 30*a* produces at its output point F such an output voltage signal that has negative inclination to decrease gradually. Next, when the signal of the oxygen content detector 10 is in the range of C in FIG. 2, making the level lower, the voltage comparator 20*b* produces high level output signal. Then the transistor 20*r* becomes conductive to make the voltage level at point D lower than that of point E. Therefore the operational amplifier 30*a* produces such an output voltage signal that has positive inclination to increase gradually. This output voltage signal is applied to the injection control circuit 22 to make the circuit operate in such a way that the injection pulse duration is rendered longer when the voltage signal from the amplifier 30*a* is higher and is rendered shorter when the voltage signal is lower, thereby controlling the air-fuel ratio of the injection valve 8*a* at about theoretical value 14.8. At this time, the air-fuel ratio of the fuel injection valves 8*b* becomes at about 19.15 making the total air-fuel ratio fix at about 18.5 in the above-described embodiment.

While a preferred embodiment of the present invention has been shown and described, it will be apparent to those skilled in the art that modifications can be made without departing from the principles and spirit of the present invention, the scope of which is defined in the appended claims.

What we claim is:

1. An electronically controlled fuel injection system for an engine exhaust system comprising an oxygen content detector mounted in said exhaust system for detecting the oxygen content in the exhaust gas to generate a control signal, computer means connected to said detecting means for producing a fuel injection signal which varies in length as a function of said control signal and a plurality of fuel injection valves mounted on the intake system of the engine and connected to said computer means for repetitively injecting the fuel into the engine in response to said injection signal, said valves being divided into at least first and second groups, the valves in one group having a diameter of injection opening greater than the valves of the other group so that said valves in said one group each inject a greater quantity of fuel than the valves of said other group an exhaust line for each of said groups of valves with one of said lines mounting said oxygen content detecting means so that said detecting means produces said control signal as a function of the ratio in that line, thereby controlling the overall air-fuel ratio at a different set value from the theoretical one.

2. An electronically controlled fuel injection system for an engine having an intake system and exhaust system, comprising, an oxygen content detector mounted in said exhaust system for detecting the oxygen content in the exhaust gas flowing in said exhaust system to produce a control signal, a computer connected with said oxygen content detector for producing a fuel injection signal in response to said control signal, and fuel injection valves mounted on said intake system and connected with said computor for injecting the fuel into said engine in response to said fuel injection signal, wherein, said exhaust system is divided into at least two lines and said oxygen content detector is mounted in one of said two lines, said fuel injection valves are also divided into at least two groups which respectively correspond to said two lines of said exhaust system, and said fuel injection valve of one of said two groups has smaller injection opening than the other, the difference of size between said smaller injection opening and the other being substantial and designed so that both fuel injection valves may inject different amounts of fuel, thereby controlling the air-fuel ratio at a predetermined value.

* * * * *